US005303831A

United States Patent [19]

Miller

[11] Patent Number: 5,303,831

[45] Date of Patent: Apr. 19, 1994

[54] HOLDER FOR BROOMS AND THE LIKE

[76] Inventor: Carl Miller, 31 Redbud Trail, Newnan, Ga. 30263

[21] Appl. No.: 107,887

[22] Filed: Aug. 19, 1993

[51] Int. Cl.[5] ..... A47F 7/00

[52] U.S. Cl. ..... 211/66; 211/89

[58] Field of Search ..... 211/65, 66, 89; 248/316

[56] References Cited

U.S. PATENT DOCUMENTS

| | | | |
|---|---|---|---|
| 1,414,541 | 5/1922 | Hern et al. | 211/65 X |
| 1,485,092 | 2/1924 | Rauchut | 211/66 X |
| 4,134,499 | 1/1979 | Joswig | 211/66 |

*Primary Examiner*—Alvin C. Chin-Shue
*Assistant Examiner*—Sarah A. Lechok
*Attorney, Agent, or Firm*—James B. Middleton

[57] ABSTRACT

A broom holder has a vertical wall and an angled wall, with a wedge held between the walls. A broom handle is placed against the vertical wall, and the wedge engages the handle and the angled wall, wedging the handle against the vertical wall. The wedge is mounted on a pivoted arm, and a release handle can be pulled down to pivot the arm, lift the wedge, and release the broom handle. The wedge is circular so orientation of the wedge is not critical. Two or more of the broom holders can be mounted on a single base board.

4 Claims, 1 Drawing Sheet

HOLDER FOR BROOMS AND THE LIKE

BACKGROUND OF THE INVENTION

1. Field Invention

This invention relates generally to holders for brooms and the like, and is more particularly concerned with a holder for broom handles utilizing a wedging action, and having a convenient release means.

2. Description of the Prior Art

Prior art holders for broom handles and the like have generally comprised a fixed wall, and a pivoted member for pinching the handle to be held between the fixed wall and the pivoted member. In such construction, the pivot point of the pivoted member receives the stress resulting from the pinching forces. As a result, the prior art devices are usually formed of metal, and may be cast or machined. While some prior art devices are formed of sheet material, the material is required to have considerable strength, so is normally made of steel. The known devices of sheet material either are quite complex, or require that the pivoted member engage the handle to be held by a knife edge. The complex device may easily get out of shape and not operate correctly, and the knife edge may mar the handle.

Thus, the prior art has not provided a holder that can be made of inexpensive materials, without critical dimensions, and with easy operation in both holding and releasing of a broom handle or the like.

SUMMARY OF THE INVENTION

The present invention includes a generally vertical fixed wall and an angular fixed wall adjacent to the vertical fixed wall. Trammeled between the vertical wall and the angular wall is a wedging member. The wedging member is movable along a pivoted arm, and is urged by gravity towards both the angular wall and the vertical wall. As a result, when a handle of a broom or the like is between the angular wall and the vertical wall, the wedging member engages both the handle and the angular wall, wedging the handle against the vertical wall. Upward force on the handle will allow the handle to be moved up, while downward force on the handle will increase the holding force to prevent movement. The pivoted arm mounting the wedging member may include a releasing means whereby the wedging member is moved up, out of contact with the handle being held.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
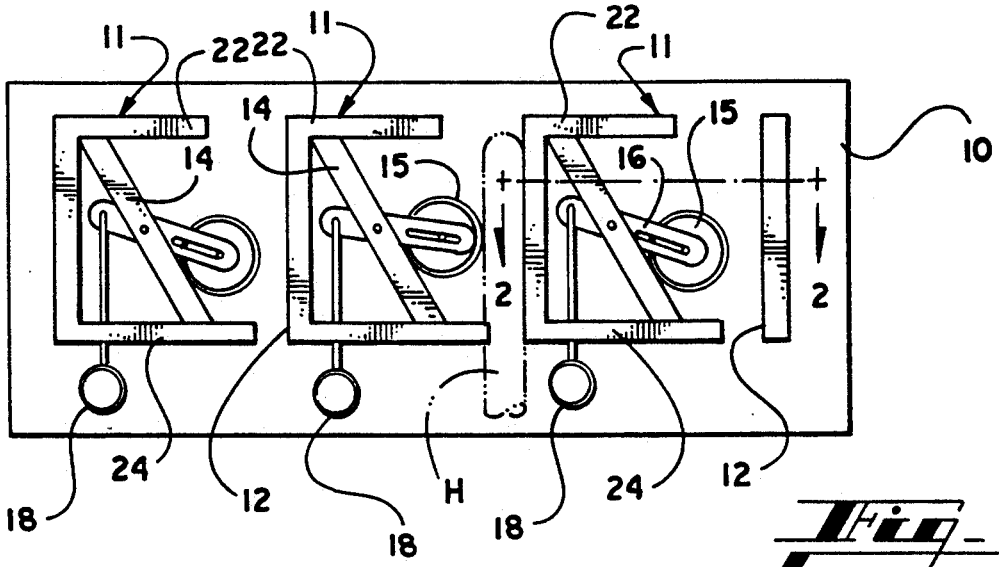
FIG. 1 is a front elevational view of a holder made in accordance with the present invention.

Referring now more particularly to the drawings, and to that embodiment of the invention here presented by way of illustration, the device shown in FIG. 1 includes a base board 10 having three holding means 11 mounted thereon. The three holding means 11 are identical, so only one will be discussed in detail. Also, the same reference numerals will be applied to similar parts. It will further be understood by those skilled in the art that any number of holding means 11 can be mounted on a single base board. While three are here shown, the specific number is a matter of choice or need.

Considering the holding means 11 in more detail, it will be seen that each of the holding means 11 includes a fixed vertical wall 12 and an angular wall 14 spaced therefrom. Between the vertical wall 12 and the angular wall 14 is the wedging member 15. It should be understood that the wedging member 15 is urged by gravity, down towards the fixed wall 12, but the wedging member is trammeled by the pivoted arm 16.

As is shown at the left and right ends of the device in FIG. 1, when there is no broom handle to be held, the wedging member 15 rests against the angular wall 14, and is limited in its downward motion by the arm 16. When there is a broom handle in position to be held, as is shown in the center of FIG. 1, the wedging member 15 is held in position by being wedged between the angular wall 14 and the handle H (shown in phantom). The wedging member 15 can be released from the handle H by pulling on the release 18, which pivots the arm 16 to move the wedging member 15 up to release the handle H.

Figure 2:
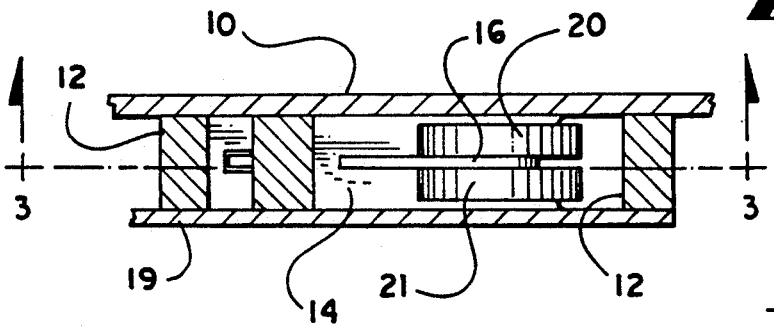
FIG. 2 is an enlarged, cross-sectional view taken along the line 2——2 in FIG. 1; and, FIG. 3 is a cross-sectional view taken along the line 3——3 in FIG. 2.

Looking briefly at FIG. 2 of the drawings, it should be understood that, in FIG. 1 of the drawings, the cover has been omitted for convenience. In FIG. 2, the cover 19 is shown; and, it should further be understood that the cover 19 is optional. The cover 19 has no functional role, but simply conceals the mechanism for aesthetic purposes. In view of this, it will be understood that the cover may also be in place, but transparent to reveal the mechanism. In this event, the parts of the mechanism can be colored to create a colorful design accent.

In FIG. 2 it can be seen that the wedging member 15 is formed of two concentric rollers 20 and 21 having the arm 16 therebetween. Those skilled in the art will realize that other arrangements are equally possible. The arm 16 could be shaped to extend along one side of the wedging member 15, or the arm 16 could fork and extend along both sides of the wedging member. Realizing that there is very little force on the arm 16 itself, many mechanical arrangements will suggest themselves.

Figure 3:
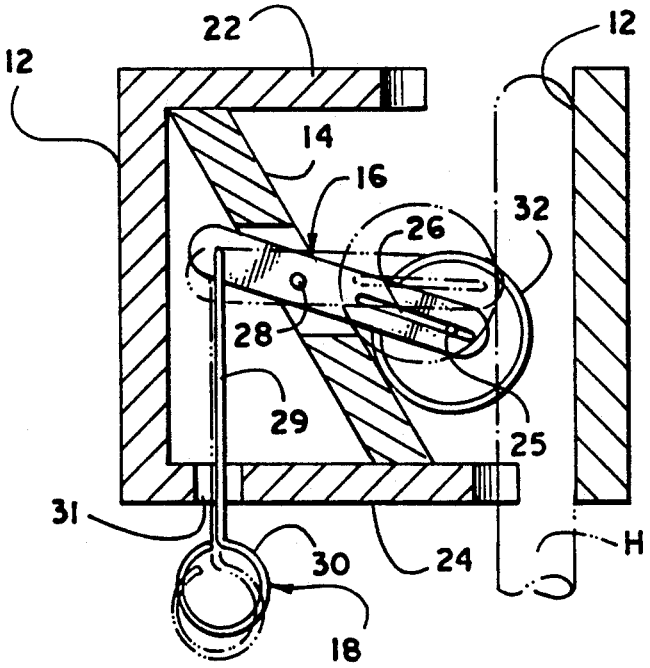

Attention is next directed primarily to FIG. 3 of the drawings which shows the construction of one holding means 11 in more detail. The holding means 11 includes upper and lower walls 22 and 24 whose primary role is to support the vertical wall 12 of the adjoining holding means 11, and the angular wall 14. The upper wall 22 and lower wall 24 stop short of the vertical wall 12 to provide sufficient space to receive a broom handle such as the handle H. It will be recognized that the upper and lower walls 22 and 24 may be omitted if the angular wall 14 can be firmly anchored to the base plate 10 by other means.

The pivoted arm 16 can be seen in detail in FIG. 3, and it will be noted that the wedging member 15 has an axle 25 about which the wedging member 15 can rotate. The axle 25 passes through an elongated slot 26 in the arm 16, and it is the slot 26 that allows the movement of the wedging member 15 along the arm 16. It can also be seen that the angular wall 14 defines a slot therethrough to receive the arm 16 and to allow pivoting motion of the arm 16. A pin 28 pivotally fixes the arm 16 to the wall 14.

On the end of the arm 16 opposite from the wedging member 15 is the releasing member 18. The member 18 is simply a wire 29 that passes through an appropriate hole in the end of the arm 16. The lowermost end of the wire 29 is formed into a loop 30. The wire 29 passes through a slot 31 in the lower wall 24, the slot 31 being long enough to allow lateral motion of the releasing means due to the arcuate motion of the upper end of the wire 29.

From the above description, it will be recognized that the wedging member 15 may take many forms. As here shown, the member 15 comprises two circular disks constituting the rollers 20 and 21. The peripheries of the rollers have a covering 32 of rubber or some such material having a large frictional coefficient. Those skilled in the art will understand that there are numerous materials that will serve the purpose. Some are elastomeric materials, and some may be harder materials that have knurling or the like on the surfaces. The only requirement is the material provide sufficient holding force to secure the handles to be held.

It will also be understood that the holding force is proportional to the angle of the angular wall 14 with respect to the vertical wall 12. In one successful model, the angle is approximately 20°; but, a smaller angle will provide greater force and a larger angle will provide less force. The angle of the wall 14 and the material of the covering 32 can be coordinated to provide the desired force.

It should be recognized that the wedging means 15 is not necessarily round. A polygon may serve as well as a circle; and, even a triangular or trapezoidal shape will work well because the operation is to have the wedging member 15 wedge itself between the handle H and the angular wall 14.

From the above and foregoing discussion, the operation of the device should be understandable. The wedging member 15 will normally move by gravity down the angular wall 14 as is shown in the left and right portions of FIG. 1. The wedging member 15 is limited in its motion by the slot 26. When a handle H is urged between the lower wall 24 and the vertical wall 12, the wedging member 15 will be engaged, and will move up as shown in phantom in FIG. 3. When the handle H is then released, the wedging member 15 will again fall down by gravity, and will become wedged between the handle H and the angular wall 14.

When the handle H is to be released, the loop 30 can be pulled down, and the arm 16 will be pivoted to raise the wedging member 15 to release the handle H. The handle H can be removed, and the wedging member 15 returns to the original position.

It will of course be understood by those skilled in the art that the particular embodiment of the invention here presented is by way of illustration only, and is meant to be in no way restrictive; therefore, numerous changes and modification may be made, and the full use of equivalents resorted to, without departing from the spirit or scope of the invention as outlined in the appended claims.

I claim:

1. A broom holder for receiving and selectively holding a broom handle, said holder comprising a fixed vertical wall, an angular wall fixed adjacent to said vertical wall so that said vertical wall and said angular wall converge towards the lower ends of said walls, said angular wall and said vertical wall being spaced sufficiently to receive a broom handle therebetween, and a wedging member movably held between said angular wall and said vertical wall, said wedging member being movable by gravity to engage said angular wall and a broom handle disposed between said angular wall and said vertical wall, and further including a pivotal arm carrying said wedging member, and release means for pivoting said arm and for releasing said wedging member from said broom handle, said pivotal arm including a first end disposed between said angular wall and said vertical wall for carrying said wedging member, and a second end disposed on the opposite side of said angular wall, said release means being fixed to said second end, said arm being pivotally carried by said angular wall, said first end of said arm defining a slot therein for movably supporting said wedging member.

2. A broom holder for receiving and selectively holding a broom handle, said holder comprising a fixed vertical wall, an angular wall fixed adjacent to said vertical wall so that said vertical wall and said angular wall converge towards the lower ends of said walls, said angular wall and said vertical wall being spaced sufficiently to receive a broom handle therebetween, and a wedging member movably held between said angular wall and said vertical wall, said wedging member being movable by gravity to engage said angular wall and a broom handle disposed between said angular wall and said vertical wall, said wedging member being circular and including an axle at the center, and including an arm for movably supporting said axle.

3. A broom holder as claimed in claim 2, said arm including a first end carrying said wedging member between said angular wall and said vertical wall, and a second end on the opposite side of said angular wall, and means for pivoting said arm substantially at said angular wall.

4. A broom holder as claimed in claim 2, said first end of said arm defining a slot therein receiving said axle, and release means for pivoting said arm about said means for pivoting.

* * * * *